US009790758B2

(12) United States Patent
Dugas et al.

(10) Patent No.: US 9,790,758 B2
(45) Date of Patent: Oct. 17, 2017

(54) APPARATUS AND METHODS FOR MECHANICALLY COUPLING A SEALING SYSTEM AROUND THE OPENING TO CELLAR FORMED AROUND A HYDROCARBON EXPLORATION OR PRODUCTION WELL

(71) Applicant: NEWPARK MATS & INTEGRATED SERVICES LLC, The Woodlands, TX (US)

(72) Inventors: Aaron William Dugas, Carencro, LA (US); Kenneth Edward Durio, Arnaudville, LA (US); James Kerwin McDowell, Lafayette, LA (US); Randy Paul Bordelon, Opelousas, LA (US); Richard Lamar Edwards, Jr., Lafayette, LA (US)

(73) Assignee: Newpark Mats & Integrated Services LLC, The Woodlands, TX (US)

( * ) Notice: Subject to any disclaimer, the term of this patent is extended or adjusted under 35 U.S.C. 154(b) by 0 days.

(21) Appl. No.: 14/666,584

(22) Filed: Mar. 24, 2015

(65) Prior Publication Data

US 2016/0090806 A1 Mar. 31, 2016
US 2017/0241228 A9 Aug. 24, 2017

Related U.S. Application Data

(63) Continuation-in-part of application No. 14/497,429, filed on Sep. 26, 2014.

(60) Provisional application No. 62/080,499, filed on Nov. 17, 2014, provisional application No. 61/889,171, filed on Oct. 10, 2013.

(51) Int. Cl.
*E21B 33/03* (2006.01)
*E21B 33/02* (2006.01)

(52) U.S. Cl.
CPC ..... *E21B 33/03* (2013.01); *E21B 33/02* (2013.01)

(58) Field of Classification Search
CPC ..... E21B 33/03; E21B 33/02
USPC ..... 166/379
See application file for complete search history.

(56) References Cited

U.S. PATENT DOCUMENTS

| | | | | |
|---|---|---|---|---|
| 5,098,220 | A * | 3/1992 | Norman | E21B 33/08 166/81.1 |
| 5,111,879 | A | 5/1992 | Jozwiak et al. | |
| 6,286,593 | B1 | 9/2001 | Holtby | |
| 6,386,225 | B1 | 5/2002 | Holtby | |
| 7,987,904 | B1 | 8/2011 | Rose | |
| 8,127,837 | B1 * | 3/2012 | Rose | E21B 33/02 166/75.11 |
| 8,770,273 | B1 | 7/2014 | Gibson | |
| 2009/0223661 | A1 | 9/2009 | Khazanovich et al. | |

(Continued)

*Primary Examiner* — Matthew R Buck
*Assistant Examiner* — Patrick Lambe
(74) *Attorney, Agent, or Firm* — E. Randall Smith; E. Randall Smith, P.C.

(57) ABSTRACT

Apparatus useful for providing a liquid-tight seal around cellar formed around a hydrocarbon exploration or production well includes a reusable load-supporting surface having at least two mats surrounding and spaced-away from the borehole opening. At least one spanner is configured to extend between the cellar wall and mats. At least one elongated spanner support is used to mechanically couple one or more spanners to the cellar wall. At least one elongated lip support is used to mechanically couple one or more spanners to the mats.

21 Claims, 14 Drawing Sheets

(56) References Cited

U.S. PATENT DOCUMENTS

| | | | |
|---|---|---|---|
| 2013/0264773 | A1 | 10/2013 | McDowell |
| 2014/0102691 | A1 | 4/2014 | Gibson |
| 2014/0255108 | A1 | 9/2014 | McDowell |

* cited by examiner

APPARATUS AND METHODS FOR MECHANICALLY COUPLING A SEALING SYSTEM AROUND THE OPENING TO CELLAR FORMED AROUND A HYDROCARBON EXPLORATION OR PRODUCTION WELL

The present application is a continuation-in-part of and claims priority to U.S. patent application Ser. No. 14/497,429, filed Sep. 26, 2014 and entitled "Apparatus and Methods for Sealing Around the Opening to an Underground Borehole", which claims priority to U.S. provisional patent application Ser. No. 61/889,171, filed on Oct. 10, 2013 and entitled "Apparatus and Methods for Sealing Around the Opening to an Underground Borehole", both of which are hereby incorporated by reference herein in their entireties. The present application also claims priority to U.S. provisional patent application Ser. No. 62/080,499, filed on Nov. 17, 2014 and entitled "Apparatus and Methods for Sealing Around the Opening to an Underground Borehole", which is hereby incorporated by reference herein in its entirety.

FIELD OF THE DISCLOSURE

The present disclosure relates to sealing around the opening to an underground borehole.

BACKGROUND

Underground boreholes are formed or used in various industries, such as hydrocarbon exploration and production wells. In the oilfield industry, for example, such wells are often formed with a "cellar" located at its upper end. The cellar is a dug-out area, or pit, at the top of the borehole which often has inner earthen walls lined with wood, cement, pipe or other material. The cellar is typically wider than the borehole and may provide additional height between the rig floor and the well head. The cellar may be useful, for example, to collect drainage water and other liquids for disposal, accommodate the installation of and/or provide access to one or more wellhead components, such as a casing spool, casing head, BOP, or other purposes.

It is often desirable to provide a liquid-tight seal around the opening to an underground borehole, such as to prevent the liquids form spilling out of the borehole onto the earth or subgrade terrain adjacent to the borehole. Sometimes, temporary or semi-permanent support surfaces are used around the borehole site. In instances where a support surface is located proximate to an underground borehole, it may likewise be desirable to provide a liquid-tight seal at the juncture of the support surface and the underground borehole, such as to prevent the liquids disposed on the support surface or within the borehole from contacting or contaminating the earth adjacent to the borehole or beneath the adjacent support surface.

Traditionally, a plastic liner is placed around the borehole (and around or below adjacent mats when a support surface is used) in an effort to capture liquids overflowing from the borehole (or introduced onto the support surface) before such liquids encounter the subgrade terrain. The use of liners may have one or more disadvantages. In many instances, the liners are not reusable and must often be discarded. This can be problematic because landfill operators have expressed disinterest in accepting used liners on the basis that they are bulky and require excessive landfill space, or for other reasons. Thus, it can be difficult to find suitable, cost-effective ways to dispose of the liners. For another example, the plastic liners are sometimes ineffective at preventing liquid leakage into the subgrade terrain or allowing effective clean-up, which can cause other problems and require significant time and effort. Thus, there is a need for improved apparatus, systems and methods for preventing liquids from entering the earth adjacent to an underground wellbore.

It should be understood that the above-described features, capabilities and disadvantages are provided for illustrative purposes only and are not intended to limit the scope or subject matter of the appended claims or those of any related patent application or patent. Thus, none of the appended claims or claims of any related application or patent should be limited by the above discussion or construed to address, include or exclude each or any of the above-cited features, capabilities or disadvantages merely because of the mention thereof herein.

Accordingly, there exists a need for improved systems, articles and methods useful in connection with sealing around the opening to an underground borehole having one or more of the attributes or capabilities described or shown in, or as may be apparent from, the various portions of this patent application.

BRIEF SUMMARY OF THE DISCLOSURE

In some embodiments, the present disclosure involves apparatus useful for providing a liquid-tight seal around cellar formed around a hydrocarbon exploration or production well. The cellar has a wall formed of wood, cement, metal or other material extending around its opening. The apparatus includes a reusable load-supporting surface having at least two load-supporting. The mats are spaced away from and at least partially surround the cellar opening. At least one planar spanner is configured to extend between the cellar wall and the mats. At least one elongated spanner support is configured to be positioned atop part of at least one spanner and used to mechanically couple such spanner (s) to the cellar wall to assist in forming a liquid tight seal therebetween. At least one elongated lip support is configured to be positioned atop or below part of at least one spanner and used to mechanically couple such spanner(s) to at least one of the mats and assist in forming a liquid tight seal therebetween. Liquid exiting the cellar through the cellar opening is prevented from contacting the earth's surface around the cellar opening.

In various embodiments, the present disclosure involves a method of providing a liquid-tight seal around a cellar formed around a hydrocarbon exploration or production well. The cellar includes a wall formed of wood, cement, metal or other material extending around its opening. At least two load-supporting mats of a reusable load-supporting surface are positioned around, and spaced-apart from, the cellar opening. At least one planar spanner is extended between the cellar wall and at least one mat. At least one elongated spanner support is positioned atop part of at least one spanner proximate to the cellar wall. Each spanner support is mechanically coupled to its associated spanner(s) and the cellar wall to assist in forming a liquid tight seal between the spanner and cellar wall. At least one elongated lip support is positioned atop or below part of at least one spanner proximate to at least one mat. Each lip support is mechanically coupled to its associated spanner(s) and mat (s).

Accordingly, the present disclosure includes features and advantages which are believed to enable it to advance technology dealing with sealing around the opening to an underground borehole. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
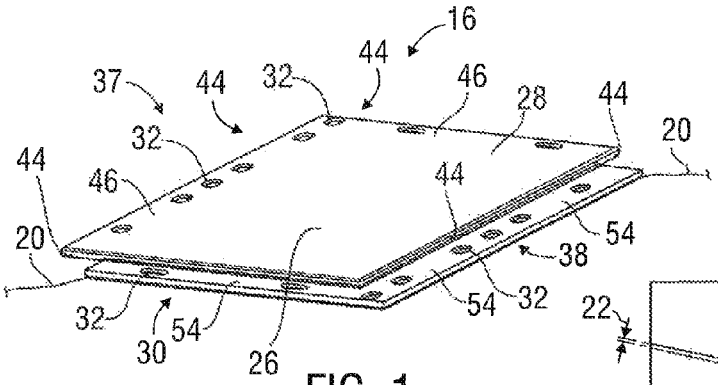
FIG. 1 is a perspective view of an exemplary mat useful in a load-supporting surface in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application or any patent or patent application claiming priority hereto. On the contrary, the intention is to cover all modifications, equivalents and alternatives falling within the spirit and scope of this disclosure or any appended claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 2:
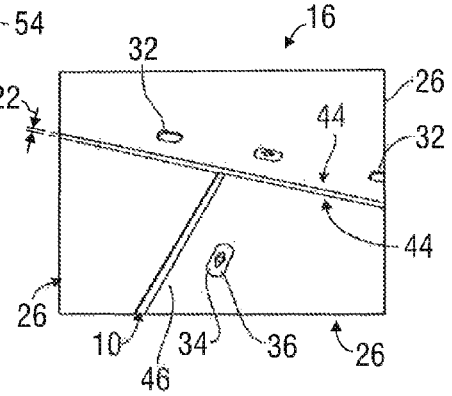
FIG. 2 is a top view of a portion of an exemplary load-supporting surface useful in accordance with an embodiment of the present disclosure.

Referring initially to FIGS. 1 and 2, an exemplary load-supporting surface 16 having at least one mat 26 deployed on or near the ground 20 is shown. As used herein, the term "ground" and variations thereof mean the earth's surface, and/or other one or more other surfaces, structures or areas proximate to the earth's surface. In the present embodiment, the load-supporting surface 16 is reusable and capable of supporting the weight of personnel, vehicles and/or equipment thereupon. The mats 26 may have any suitable form, construction and configuration. Some examples of mats 26 which may be used in various embodiments of the present disclosure are shown and described in in U.S. Pat. No. 5,653,551 to Seaux, entitled "Mat System for Construction of Roadways and Support Surfaces" and issued on Aug. 5, 1997, and U.S. Pat. No. 6,511,257 to Seaux et al., entitled "Interlocking Mat System for Construction of Load Supporting Surfaces" and issued on Jan. 28, 2003, both of which have a common Assignee as the present patent and the entire contents of which are hereby incorporated by reference herein in their entireties.

For example, each exemplary mat 26 may weight approximately 1,000 lbs., be designed to withstand 600 psi in pure crush pressure placed thereupon, and reduce point-to-point ground pressure on the ground 20 or other surface or area below it that is caused by wheeled and tracked vehicles on the mat 26. In some embodiments, the mats 26 may be 14'×8' DURA-BASE® mats currently sold by the Assignee of this patent application. However, these example features are not necessarily required for every embodiment.

If desired, the load supporting surface 16 may be used in connection with any of the components and features described and shown in U.S. patent application Ser. No. 13/790,916, filed on Mar. 8, 2013 and entitled "Liquid Containment System for Use with Load-Supporting Surfaces", U.S. patent application Ser. No. 14/336,163, filed on Jul. 21, 2014 and entitled "Apparatus and Methods for Providing Illuminated Signals from a Support Surface", U.S. patent application Ser. No. 14/496,105, filed on Sep. 25, 2014 and entitled "Apparatus & Methods for Electrically Grounding a Load-Supporting Surface" each of which has a common Assignee as the present patent and the entire contents of which are hereby incorporated by reference herein in their entireties.

Still referring to FIGS. 1 and 2, in the illustrated embodiment, each mat 26 is flat, or planar, heavy duty, durable, all-weather and constructed of impermeable material, such as thermoplastic material. The exemplary mats 26 are reusable and interlock together to form the load-supporting surface 16.

The illustrated mat 26 has a rectangular shape with an opposing pair of short sides 28, 30, an opposing pair of long sides 37, 38, and an edge 44 extending along each side 28, 30, 37 and 38. In this particular example, the first short side 28 and first long side 37 each have an upper lip 46 extending horizontally outwardly therefrom, forming the edge 44 and which will be spaced above the ground 20 or other surface. The second short side 30 and second long side 38 each have a lower lip 54 extending horizontally outwardly therefrom below the edge 44 thereof and which will rest on the ground 20 or other surface. The upper and lower lips 46, 54 may have any suitable size, shape, configuration and length. It should be understood, however, that the borehole edge seal system 110 of the present disclosure is not limited to use with the above-described embodiments of mats 26. For example, other embodiments of the borehole edge seal system 110 may be used in connection with mats 26 not having upper and/or lower lips 46, 54.

Figure 10:
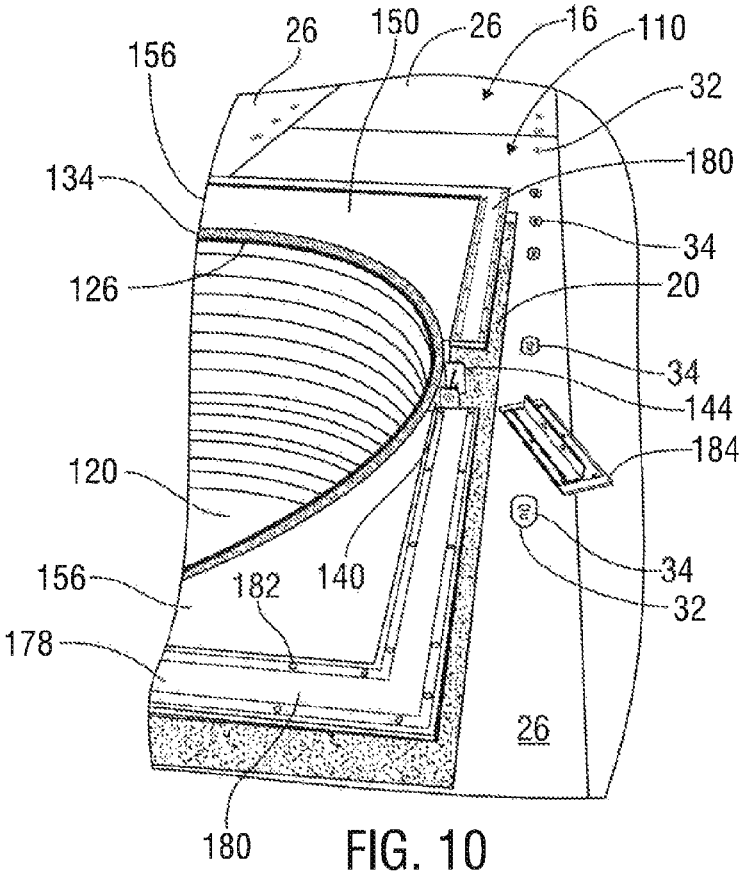
FIG. 10 is a perspective view of a borehole equipped with an embodiment of a borehole edge seal system having an outside-clamp arrangement in accordance with the present disclosure.
Figure 12:
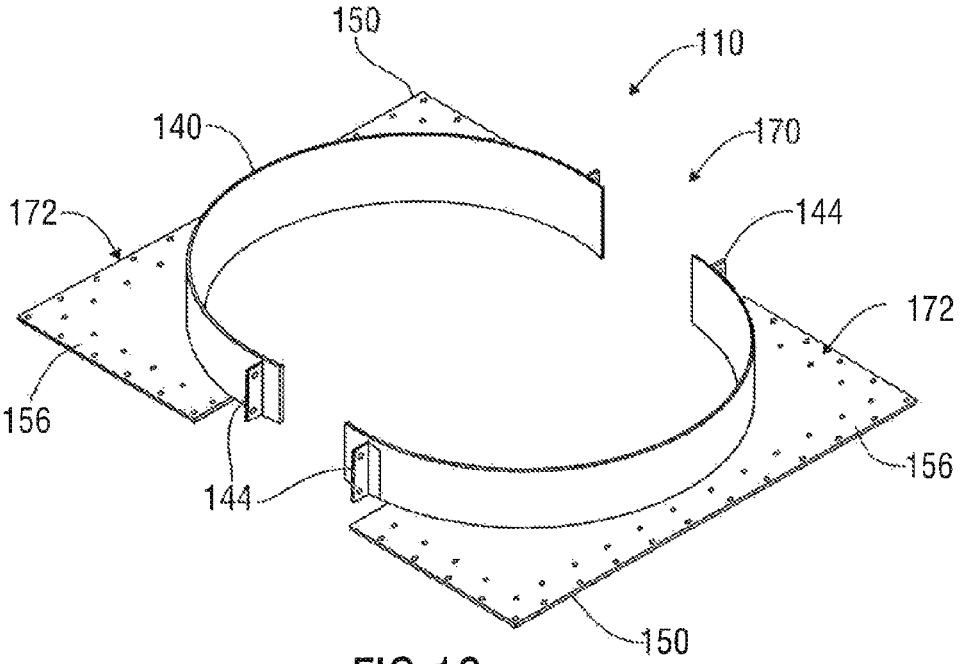
FIG. 12 is a perspective view of an embodiment of an integrally formed platform-clamp unit useful as part of a borehole edge seal system in an outside-clamp arrangement in accordance with the present disclosure.

In this embodiment, the respective upper and lower lips 46, 54 of different mats 26 are interconnectable with locking pins 34 (e.g. FIGS. 2 & 10) releasably securable through corresponding locking pin holes 32 formed therein. The locking pin holes 32 and locking pins 34 may have any suitable form, construction and configuration. The illustrated mats 26 include a plurality of locking pin holes 32, each configured to accept a releasable locking pin 34 (e.g. FIG. 2) therethrough. Each illustrated mat 26 may include a total of sixteen locking pin holes 34, eight formed in each of the upper and lower lips 46, 54. In some embodiments, the locking pins 34 may form a liquid-tight seal around, or in, the locking pin holes 32 within which they are engaged. Some examples of locking pins 34 which may be used in various embodiments of the present disclosure are shown and described in U.S. Pat. No. 6,722,831 to Rogers et al, entitled "Fastening Device" and issued on Apr. 20, 2004 and U.S. patent application Ser. No. 13/780,350, entitled "Apparatus and Methods for Connecting Mats" and filed on Feb. 28, 2013, both of which have a common Assignee as the present patent and the entire contents of which are hereby incorporated by reference herein in their entireties.

In the illustrated example, the locking pin holes 32 of the mats 26 have an oval-shape to accept an oval-shaped enlarged head 36 (e.g. FIG. 2) of the illustrated locking pins 34. It should be noted, however, that the present disclosure is not limited to use with the above-described or referenced types and configurations of load-supporting surfaces 16, mats 26, locking pins 34 and locking pin holes 32, or to the disclosures of the above-referenced patents and patent applications. Any suitable load-supporting surfaces 16, mats 26, locking pins 34 and locking pin holes 32 may be used.

Still referring to FIGS. 1 and 2, in some embodiments, a gap 22 may be formed between adjacent edges 44 of adjacent interconnected mats 26 in the load-supporting surface 16 and one or more seal members 10 may be included therein. For example, the seal member(s) 10 may provide a liquid-tight seal in the gap 22 between adjacent mats 26 to prevent liquid introduced onto the load-supporting surface 16 from seeping or flowing between and below the load-supporting surface 16. Some embodiments of seal members that may be used in the gaps 22 are disclosed in U. S. patent application Ser. No. 13/803,580, filed on Mar. 14, 2013 and entitled "Apparatus and Methods for Sealing Between Adjacent Components of a Load-Supporting Surface", U. S. Provisional Patent Application Ser. No. 62/013,899, filed on Jun. 18, 2014 and entitled "Load-Supporting Surface with Interconnecting Components and Top Side Seal Assembly for Sealing Therebetween and Methods of Assembly and Use Thereof", U.S. Provisional Patent Application Ser. No. 62/011,805, filed on Jun. 13, 2014 and entitled "Load-Supporting Surface with Interconnecting Components and Frame-Style Seal Assembly for Sealing Therebetween and Methods of Assembly and Use Thereof", and U.S. Provisional Patent Application Ser. No. 62/116,989, filed on Feb. 17, 2015 and entitled "Load-Supporting Surface with Interconnecting Components and Frame-Style Seal Assembly for Sealing Therebetween and Methods of Assembly and Use Thereof", all of which have a common Assignee as the present patent and the entire contents of which are hereby incorporated by reference herein in their entireties.

The seal member(s) 10 may also or instead be used between one or more mats 26 and one or more other components associated with the load-supporting surface 16, and/or between the other components themselves. Some examples of such additional components that may be useful in connection with load-supporting surfaces 16, such as berm members, spacers, drive-over barriers, liquid drain assemblies, etc., are shown and disclosed in U.S. patent application Ser. No. 13/790,916, entitled "Liquid Containment System for Use With Load-Supporting Surfaces" and filed on Mar. 8, 2013.

Figure 3:
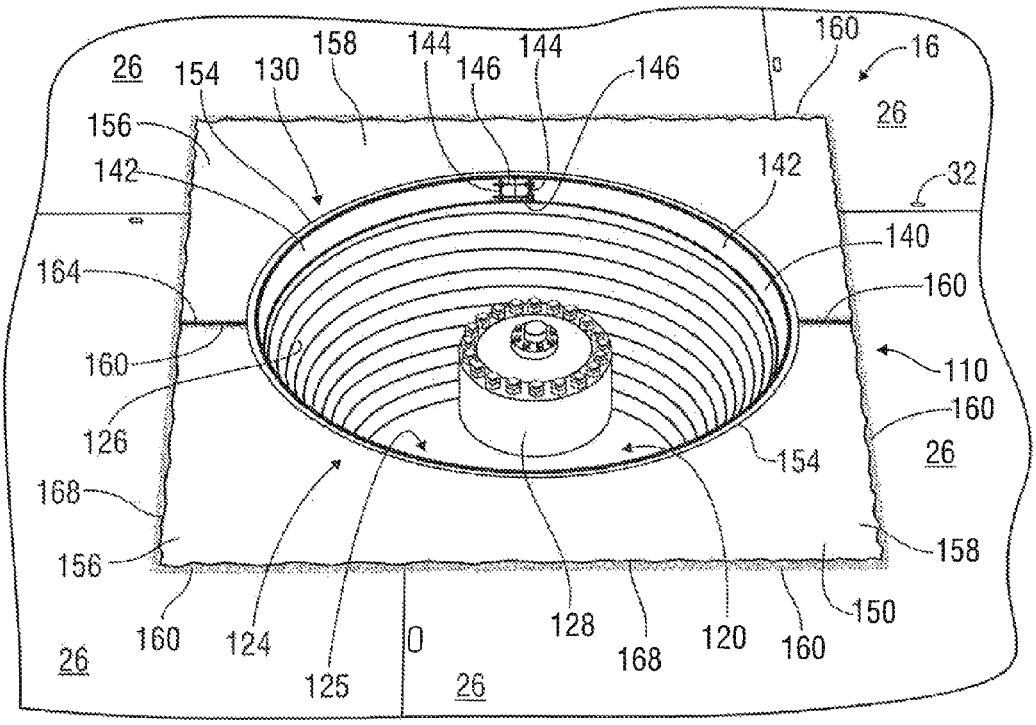
FIG. 3 is a perspective view of a borehole equipped with an embodiment of a borehole edge seal system having an inside-clamp arrangement in accordance with the present disclosure.

Referring now to FIG. 3, an embodiment of a borehole edge seal system 110 is shown used in connection with a load-supporting surface 16 around an underground borehole 120 in accordance with the present disclosure. This particular borehole 120 is a hydrocarbon well 124 with a wide section, or cellar, 125 at its upper end. The exemplary borehole 120 has an opening 130 (at the upper end of the cellar 125) that is accessible from the earth's surface. However, the borehole edge seal system 110 of the present disclosure is not limited to use with hydrocarbon wells, but may be used with any underground hole accessible from the ground. Thus, as used herein, the terms "borehole" and variations thereof mean any hole or orifice in the earth that is accessible from an opening in the surface of the earth or other area or structure. In the detailed description herein, the term "borehole" includes, or refers to, the "cellar" located at the upper end of the borehole as reference above. In other words, the detailed description herein is written from the perspective that a "cellar" is a form of, or may be the upper part of, a borehole.

This particular borehole 120 (e.g. well 124 with cellar 125) includes a wellhead 128 accessible through the cellar 125 and a wall 126 extending around the cellar 125. In this instance, the wall 126 is metallic and extends up to the earth's surface (not shown), but may be constructed of any other material (e.g. wood, plastic, etc.) and may extend above or below the earth's surface. Further, these components may not be included in the borehole 120. The illustrated borehole 120, opening 130 and wall 126 have a circular outer shape, but instead may be rectangular (see e.g. FIG. 13) or have any other shape. Thus, the shapes of the perimeter of the borehole 120, opening 130 and wall 126 are not limiting upon the present disclosure.

The borehole edge seal system 110 may have any suitable form, configuration and operation as long as it assists in providing a liquid-tight seal around the opening 130. As used herein, the terms "liquid-tight seal", "sealing engagement", "sealingly coupling" and variations thereof are synonymous and means at least substantially preventing the passage of liquid thereby. A "liquid tight seal" around the opening 130, for example, means assisting in preventing the passage of liquid from inside the borehole 120 through its opening 130 to the earth around and/or adjacent to the opening 130. The exemplary system 110 thus assists in preventing liquid inside the borehole 120 from exiting the borehole 120 through the opening 130 and contacting the area (e.g. ground) adjacent to or surrounding the opening 130. In some embodiments, a complete fluid tight seal may be provided. However, as used herein, a "liquid-tight seal" between components or "sealingly engaged" or "sealingly coupled" components, and variations thereof, may not necessarily always be 100% liquid-tight, but may include some allowance for minimal leaking as can be expected or tolerated depending upon each particular application.

Still referring to FIG. 3, the illustrated system 110 includes a clamp 140 and a platform 150. The platform 150 assists in sealing around the opening 130, while the clamp 140 holds the platform 150 in place. The clamp 140 and platform 150 may have any suitable form, configuration and operation. In this embodiment, the clamp 140 is metallic and includes two curve-shaped clamp sections, or portions 142. At each end, each exemplary clamp section 142 includes a connection bracket 144 protruding inwardly therefrom.

The illustrated clamp sections 142 are adjustably engageable at each end at the adjacent brackets 144 with at least one connector 146, such as a bolt. When connected, the clamp sections 142 form a ring that fits within the opening 130 of the borehole 120. In other embodiments, the clamp 140 may be a single adjustable ring (not shown) or have any other suitable configuration and composition.

Still referring to FIG. 3, the illustrated platform 150 is plastic, and includes a ring-shaped collar portion 154 and a body portion 156. In this particular instance, the platform 150 includes two platform sections 158, but could instead be a single component or have any other number of platform sections 158. In this particular embodiment, the platform 150 is configured to extend over the edge of the opening 130 and across the surface of the earth or other area or structure adjacent to the opening 130.

In use of the illustrated system 110, the platform 150 is placed over the borehole 120 so that its collar 154 extends into the borehole opening 130. If the platform 150 has multiple sections 158, they are appropriately positioned over the opening 130. If desired, the sections 158 may be connected or sealed together. For example, the platform sections 158 may be welded together, such as with a thermoplastic sealant material 160, at the seams, or overlaps, 164 formed therebetween to assist in providing a liquid-tight seal.

If desired, one or more seals, such as a closed-cell neoprene foam rubber seal or elastomeric seal ring, (not shown) may be sandwiched between the collar 154 of the platform 150 and the borehole wall 126. The exemplary clamp 140 is then inserted into the borehole 120 and positioned over the collar 154. The illustrated clamp 140 is tightened against the collar 154, seal(s) (if included) and borehole wall 126. In this embodiment, two sets of connectors 146, such as bolts, are inserted through the corresponding inwardly-protruding connection brackets 144 of the adjacent clamp sections 142 and tightened sufficiently to secure the system 110 to the borehole wall 126. This is an example of an "inside-clamp" arrangement, where the clamp 140 engages the inside of the borehole wall 126. As will be described below, other embodiments are referred to as "outside-clamp" arrangements, where the clamp 140 engages the outside of the borehole wall 126.

Still referring to FIG. 3, when the borehole edge seal system 110 is used in connection with a load-supporting surface 16, the body 156 of the platform 150 may be connected to adjacent mats 26 or other components. For example, the platform 150 may be sealingly engaged with adjacent mats 26. In this embodiment, the outer edges 168 of the platform 150 are welded to adjacent mats 26 using the thermoplastic sealant material 160.

Figure 4A:
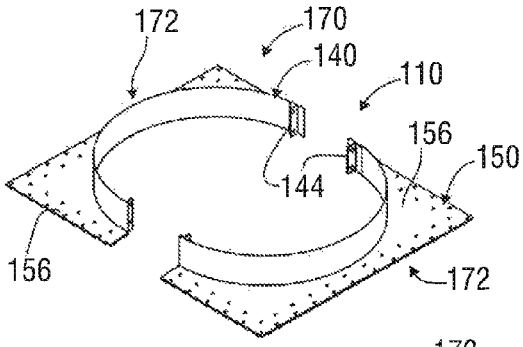
FIG. 4A is a bottom view of an embodiment of an integrally formed platform-clamp unit useful as part of an inside-clamp arrangement of a borehole edge seal system in accordance with the present disclosure.
Figure 4B:
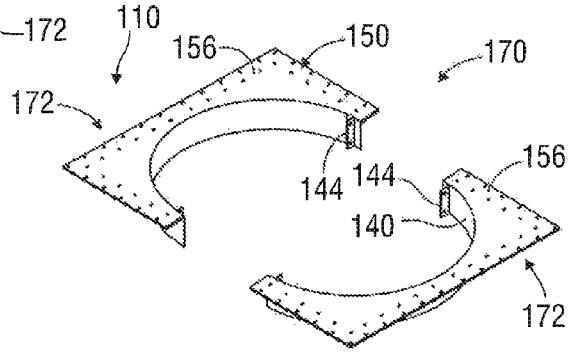
FIG. 4B is a top view of the platform-clamp unit of FIG. 4A.
Figure 7A:
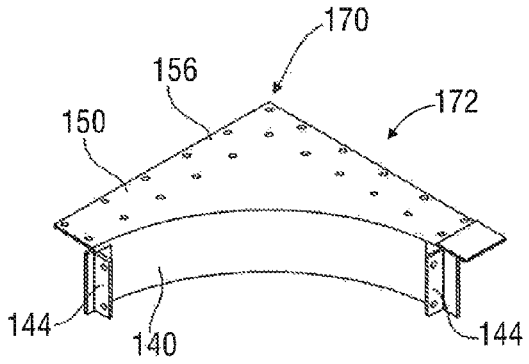
FIG. 7A is a perspective view of a quarter section of an embodiment of an integrally formed platform-clamp unit useful as part of a borehole edge seal system in an inside-clamp arrangement in accordance with the present disclosure.
Figure 7B:
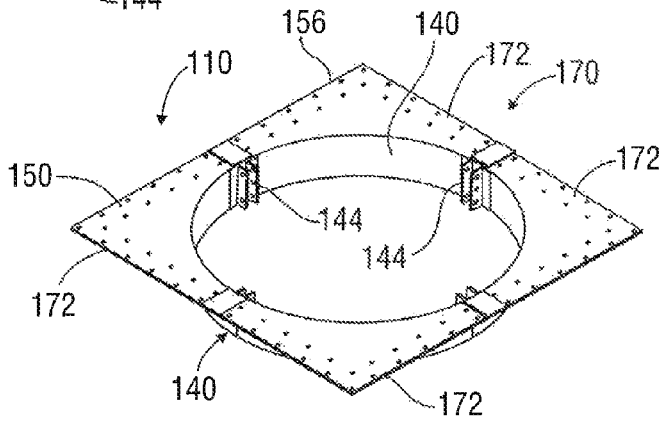
FIG. 7B is a perspective view of an embodiment of an integrally formed platform-clamp unit incorporating four of the quarter sections shown in FIG. 7A.

Now referring to FIGS. 4A & 4B, in some embodiments, the borehole edge seal system 110 may include a clamp 140 and platform 150 that are connected together, or integrally formed. For example, the clamp 140 and platform 150 may be integrally formed of metallic material, such as steel, into a unitary platform-clamp unit 170. In this embodiment, the platform 150 does not have a separate collar, and the platform-clamp unit 170 includes two sections 172 that are engageable similarly as the clamp sections 142 and platform sections 158 described with respect to FIG. 3 above. However, the platform-clamp unit 170 may instead be a single component or include any other number of sections 172. For example, the platform-clamp unit 170 of FIGS. 7A, 7B and 8 includes four similarly interconnectable sections 172.

Figure 5:
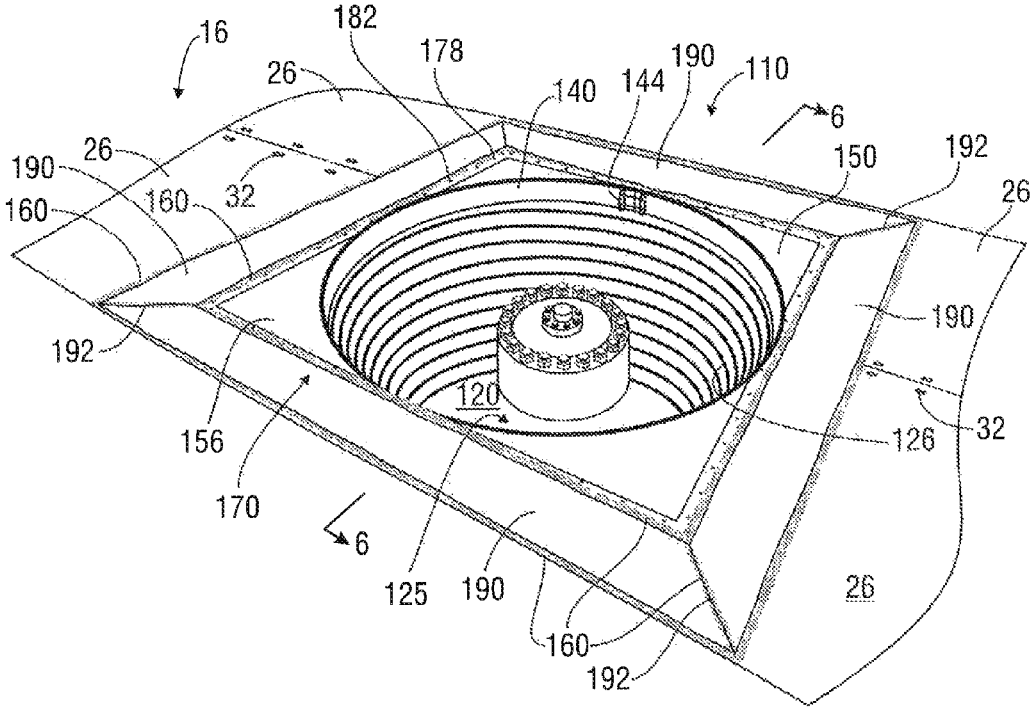
FIG. 5 is a top view of a borehole equipped with another embodiment of a borehole edge seal system having an inside-clamp arrangement in accordance with the present disclosure.
Figure 6:
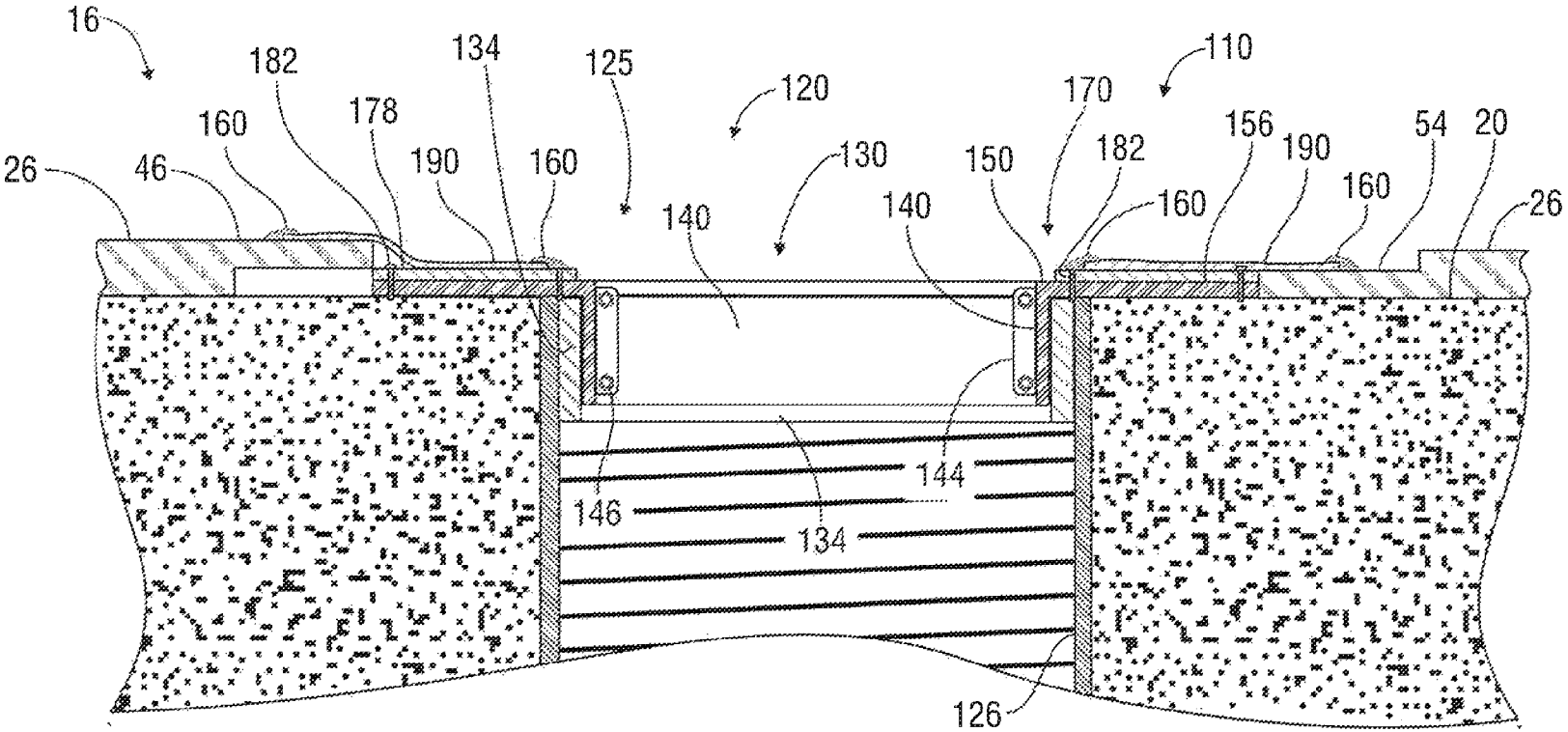
FIG. 6 is a cross-sectional view of the borehole and borehole edge seal system of FIG. 5 taken along lines 6-6.

Now referring to FIGS. 5 & 6, the borehole edge seal system 110 of FIG. 4A is shown in use with a load-supporting surface 16 around a borehole 120. Referring specifically to FIG. 6, the exemplary platform-clamp unit 170 is placed in the borehole 120 so that the clamp 140 extends around the inside of the opening 130 of the borehole 120. If desired, a seal ring 134, such as a closed-cell neoprene foam rubber or elastomeric seal, may be sandwiched between the clamp 140 and borehole wall 126 to assist in providing a liquid-tight seal. In this example, the body 156 of the platform 150 rests on the ground 20. However, there may instead be an intermediated component, ground covering or space between the platform body 156 and the ground 20.

In this particular embodiment, a frame 178 is connected to the top of the platform body 156 around the entire perimeter of the platform-clamp unit 170. The frame 178 may have any suitable form, configuration and operation. The illustrated frame 178 is plastic and connected to the platform 150 with two rows of connectors 182, such as bolts. If desired, at least one seal, such as a closed-cell neoprene foam rubber gasket (not shown), may be sandwiched between the frame 178 and platform 150. However, the frame 178, if included, may be constructed of any other suitable material and connected to the platform 150 in any other suitable manner.

Still referring to FIG. 6, the system 110 may be engaged with the adjacent mats 26 or other components of the load-supporting surface 16. In this example, plastic sheeting 190 extends from the frame 178 to the adjacent mats 26. One example of presently commercially available plastic sheeting is Site Saver Flat Sheet manufactured by Penda Corporation and distributed by HMI Materials, Inc. The plastic sheeting 190 may be sealingly engaged with the frame 178 and mats 26, such as by welding with a thermoplastic sealant material 160. If the plastic sheeting 190 has multiple sections, the seams 192 (FIG. 5) formed therebetween may also be sealed, such as with the thermoplastic sealant material 160. However, any other material(s) or component(s) may be used to sealingly engage the frame 178 to the adjacent mats 26 or other components. For example, one or more bolting strips (not shown) may extend from the frame 178 to the adjacent mats 26 and form a liquid seal therewith and therebetween, similarly as described above with respect to the plastic sheeting 190. The bolting strip may be constructed of any suitable material, such as plastic or metal, and may be engaged with the frame 178 and adjacent mats 26 in any suitable manner, such as with mechanical fasteners (e.g. bolts). One or more suitable sealants (silicone glue) or sealing materials (e.g. plastic sheeting) may be used between the bolting strip and the frame 178, mats 26, and/or over or around the mechanical fasteners.

Figure 8:
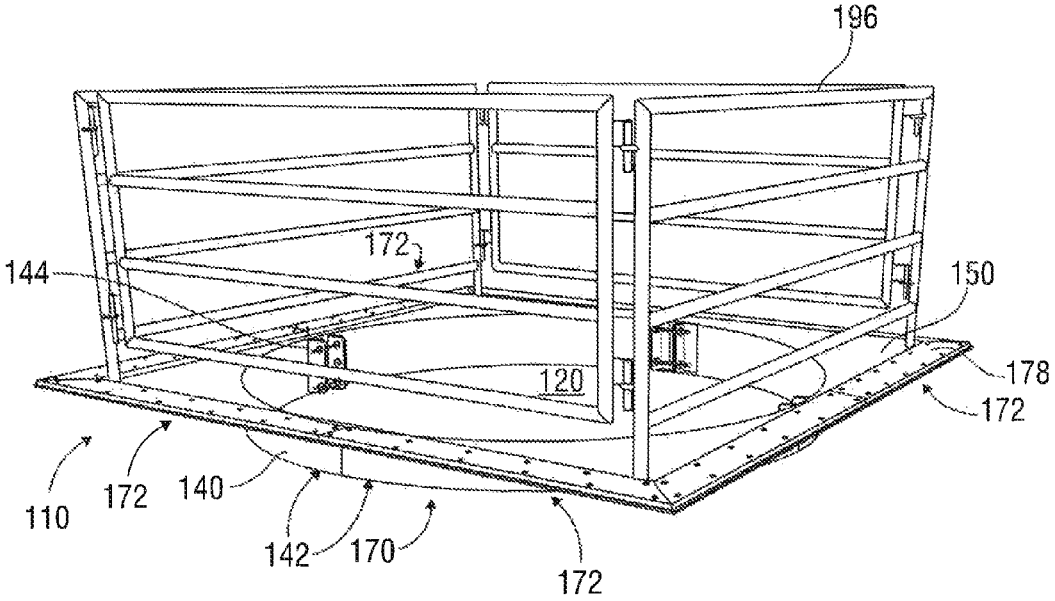
FIG. 8 is a perspective view of an embodiment of a borehole edge seal system having an inside-clamp arrangement and including an exemplary arrangement of rails in accordance with the present disclosure.
Figure 9:
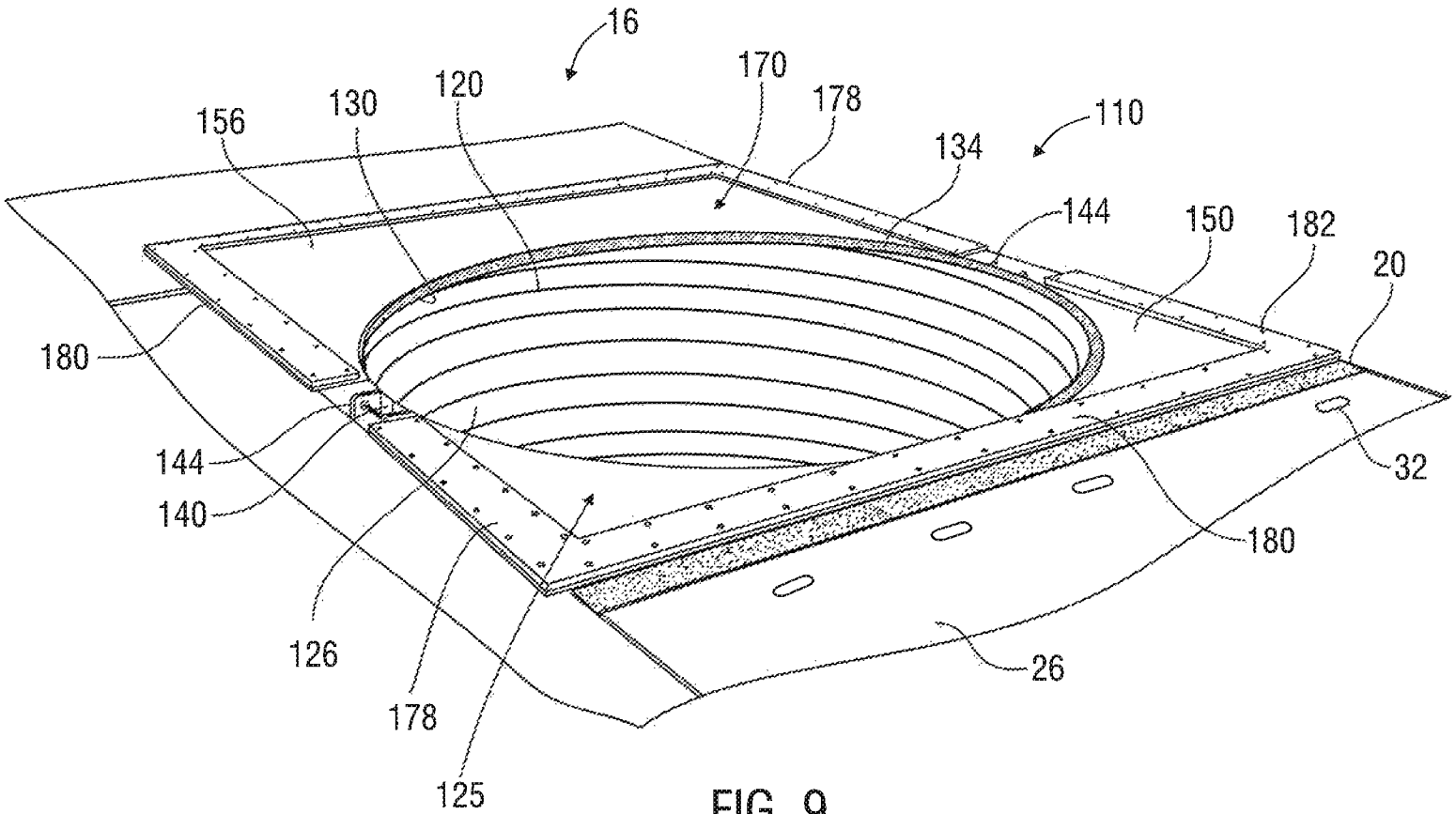
FIG. 9 is a perspective view of a borehole equipped with an embodiment of a borehole edge seal system having an outside-clamp arrangement in accordance with the present disclosure.
Figure 13:
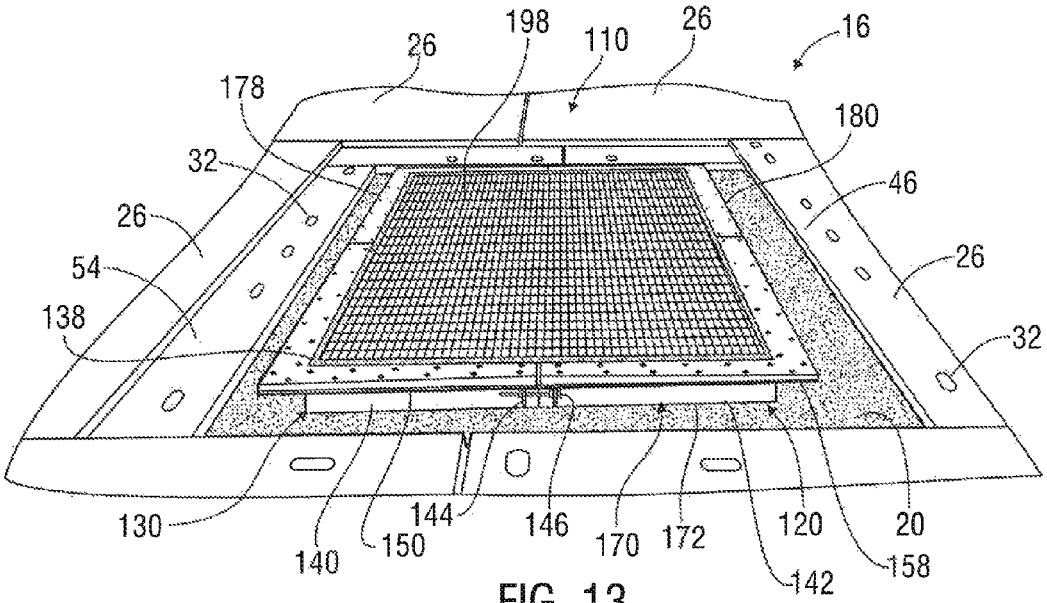
FIG. 13 is a perspective partial view of a borehole equipped with an embodiment of a borehole edge seal system used in an outside-clamp arrangement with a rectangular-shaped borehole in accordance with the present disclosure.

Referring to FIG. 8, if desired, an arrangement of rails 196 may be provided around the borehole edge seal system 110 and borehole 120, such as to limit access thereto and/or for safety. As shown in FIG. 13, a metal grating 198 may be also or instead be emplaced over the borehole 120, such as to limit access thereto and/or for safety. However, the present disclosure does not require either of these features.

Now referring to FIGS. 9-12, an embodiment of the borehole edge seal system 110 is shown used with a borehole 120 having a wall 126 that extends above the ground 20. The illustrated clamp 140 and platform 150 are integrally formed of metallic material, such as steel, into a unitary platform-clamp unit 170. In this embodiment, the platform-clamp unit 170 includes two sections 172 (FIG. 12) that are engageable similarly as the clamp sections 142 and platform portions, or sections, 158 described with respect to FIG. 3 above. However, in this embodiment, the connection brackets 144 of the clamp 140 are on the outside of the clamp 140 so the clamp 140 can be tightened around the outside of the borehole wall 126. This is an example of an "outside-clamp" arrangement, where the clamp 140 engages the outside of the borehole wall 126. As in the other embodiments, the platform-clamp unit 170 may instead be a single component or include any other number of sections 172.

Figure 11:
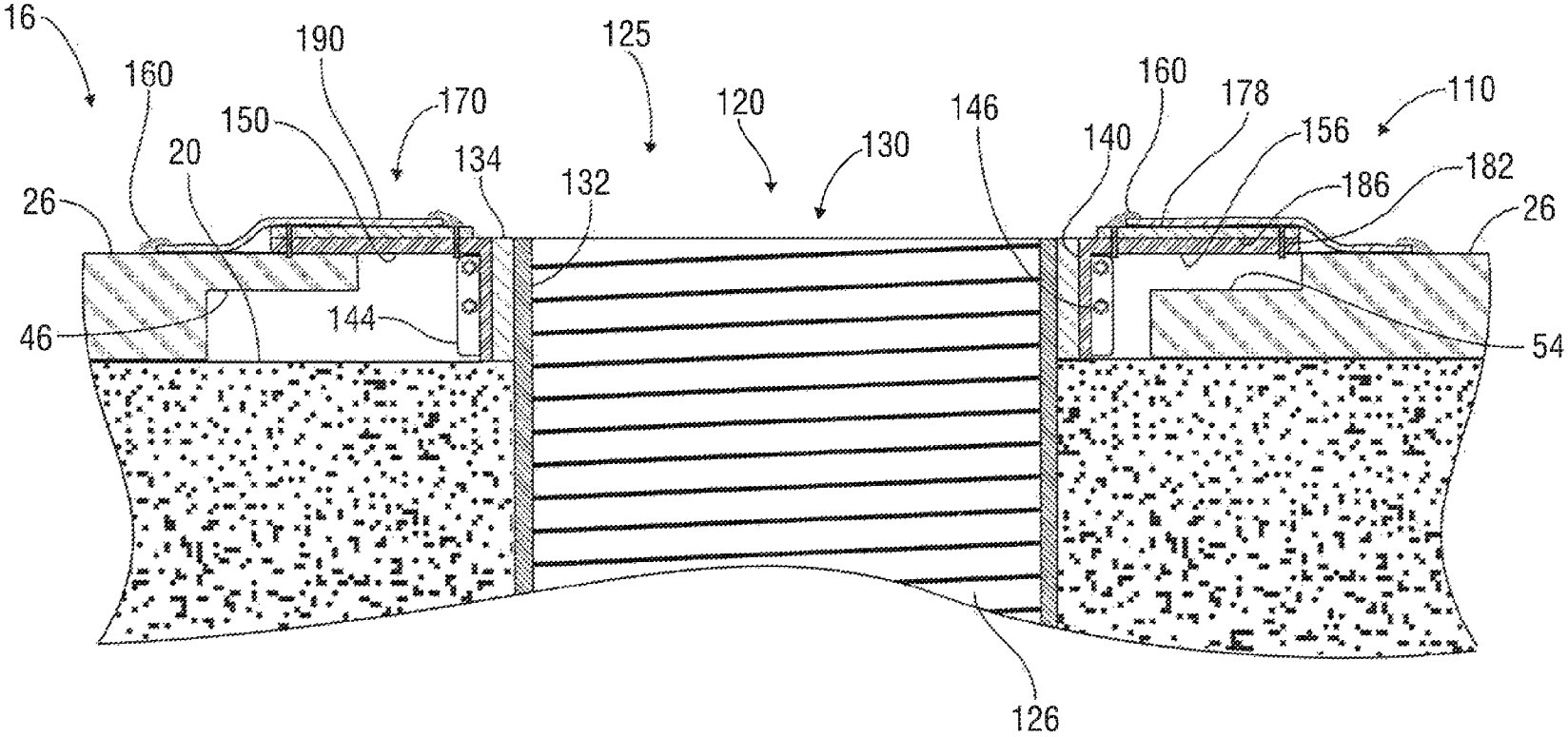
FIG. 11 is a cross-sectional view of a borehole equipped with an embodiment of a borehole edge seal system having an outside-clamp arrangement in accordance with the present disclosure.

Referring specifically to FIG. 11, the exemplary platform-clamp unit 170 is placed around the upwardly protruding portion 132 of the borehole wall 126 so that the clamp 140 extends around the outside of the opening 130. If desired, at least one seal, such as a closed-cell neoprene foam rubber or elastomeric seal ring 134, may be sandwiched between the clamp 140 and borehole wall 126 to assist in providing a liquid-tight seal. In this example, the body 156 of the platform 150 is shown spaced upwardly off of the ground 20. However, there may instead be an intermediate component or ground covering between the platform body 156 and the ground 20.

Still referring to FIG. 11, in this embodiment, a frame 178 is connected to the top of the platform body 156 around the entire perimeter of the platform-clamp unit 170. The frame 178 may have any suitable form, configuration and operation. The illustrated frame 178 is plastic and connected to the platform 150 with two rows of connectors 182, such as bolts. In this example, the frame 178 has two frame sections 180 (e.g. FIG. 9) and a pair of removable bracket covers 184 (e.g. FIG. 10) positionable therebetween. The illustrated bracket covers 184 allow access to the connection brackets 144 of the clamp 140. If desired, at least one seal, such as a closed-cell neoprene foam rubber gasket 186 may be sandwiched between the frame 178 and platform 150. However, the frame 178, if included, may be constructed of any other suitable material and connected to the platform 150 in any other suitable manner.

Still referring to FIG. 11, the illustrated system 110 may be engaged with the adjacent mats 26 or other components of the load-supporting surface 16. In this example, plastic sheeting 190 extends from the frame 178 to the adjacent mats 26. The plastic sheeting 190 may, if desired, be sealingly engaged with the frame 178 and mats 26, such as by welding with a thermoplastic sealant material 160. If the plastic sheeting 190 has multiple sections, the seams (not shown) formed therebetween may also be sealed, such as with the thermoplastic sealant material 160. However, any other material(s) or component(s) may be used to sealingly engage the frame 178 to the adjacent mats 26 or other components.

Figure 14:
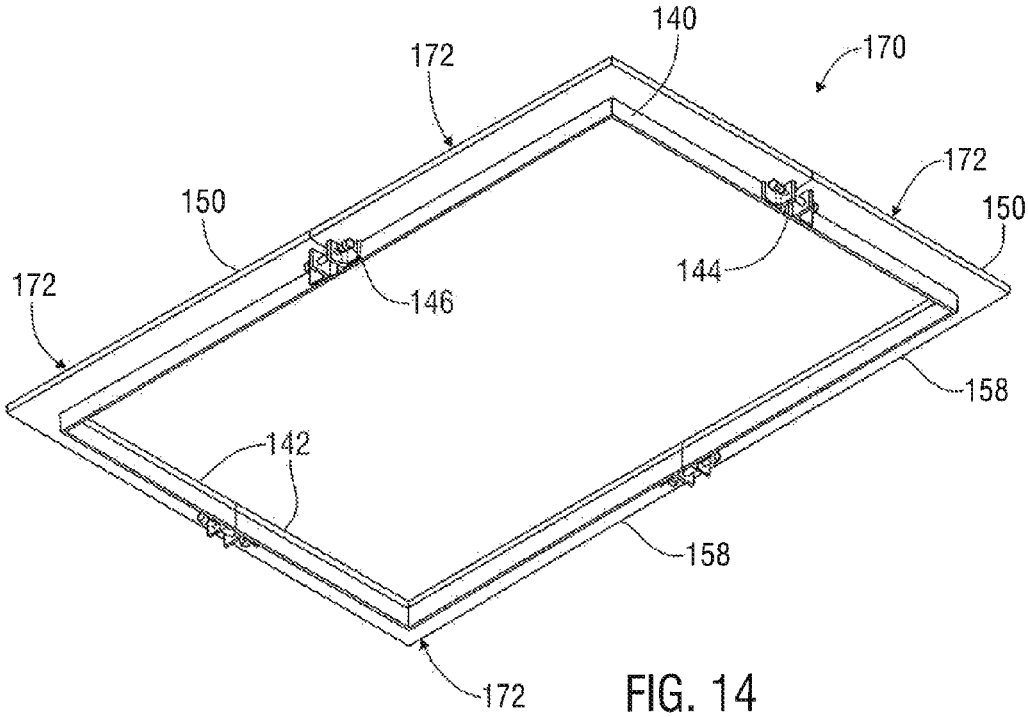
FIG. 14 is a perspective view of an embodiment of a rectangular shaped platform-clamp unit useful in the exemplary borehole edge seal system shown in FIG. 13.

Now referring to FIGS. 13 & 14, an embodiment of the borehole edge seal system 110 useful with a rectangular shaped borehole 120 is shown. The exemplary borehole 120 has a wall (not shown) that extends above the ground 20. The illustrated clamp 140 and platform 150 are integrally formed of metallic material, such as steel, into a unitary platform-clamp unit 170. In this embodiment, the platform-clamp unit 170 includes four sections 172 that are engageable similarly as the sections 172 described with respect to FIGS. 9-11 above. As shown, the illustrated connection brackets 144 of the clamp 140 are on the outside of the clamp 140 so the clamp 140 can be tightened around the outside of the borehole wall (not shown). As in the other embodiments, the platform-clamp unit 170 may instead be a single component or include any other number of sections 172.

In this embodiment, one or more seals (not shown) may be placed between the clamp 130 and the borehole wall (not shown). The seal may have any suitable form, configuration and operation. In this example, the seal is a band of a closed-cell neoprene foam rubber extended around the perimeter of the rectangular borehole wall (not shown). This embodiment also includes an optional metal grating 198 placed over the borehole 120, such as to limit access thereto and/or for safety. Otherwise, the features, assembly and operation of the platform-clamp unit 170 of this embodiment are similar to the embodiment of FIGS. 9-12.

FIGS. 15A-20 illustrate another embodiment of a borehole edge seal system 110 in accordance with the present disclosure. Other than as may differ in the following description or as may be evident from FIGS. 15A-20, all of the features of the previously described and illustrated embodiments and all of the above details are similarly applicable to these embodiments.

Figure 15A:
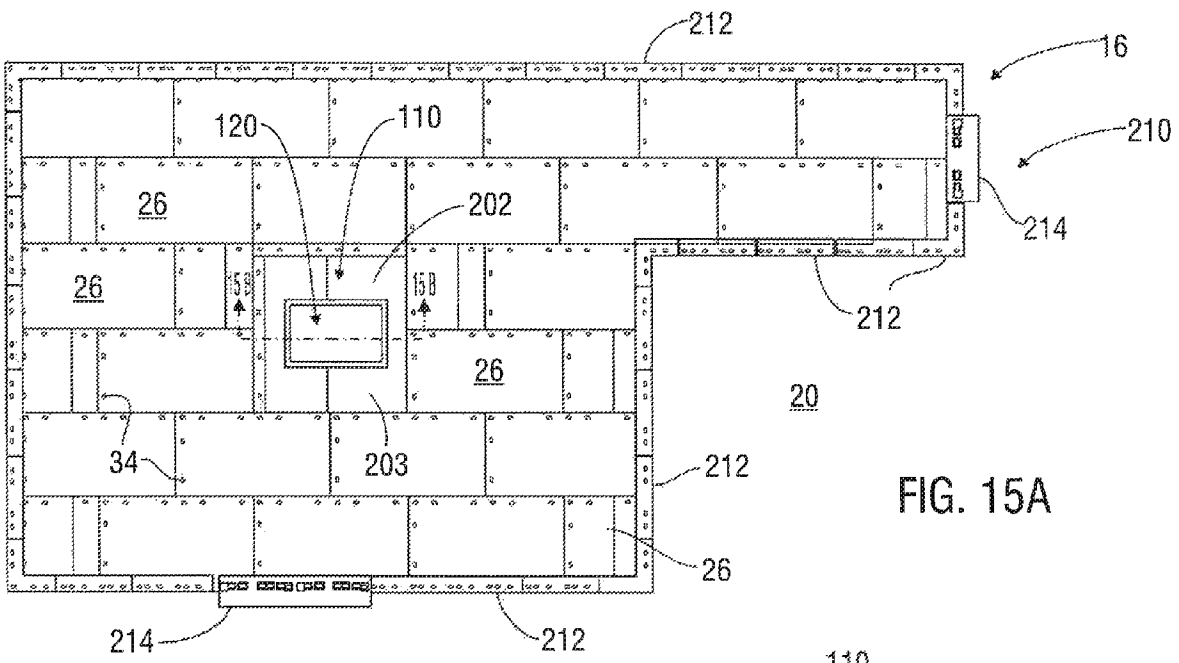
FIG. 15A is a top view of an exemplary load-supporting surface having another embodiment of a borehole edge seal system in accordance with the present disclosure.
Figure 15B:
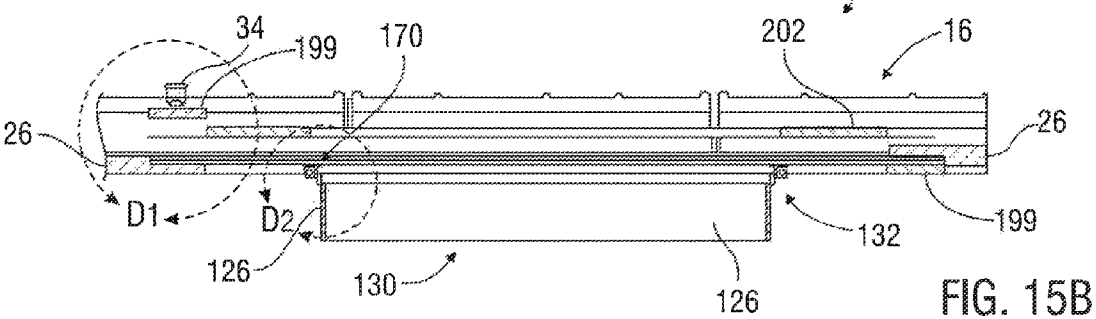
FIG. 15B is a partially exploded, partial cross-sectional view of the exemplary load-supporting surface of FIG. 15A taken along lines 15B-15B.
Figure 15C:
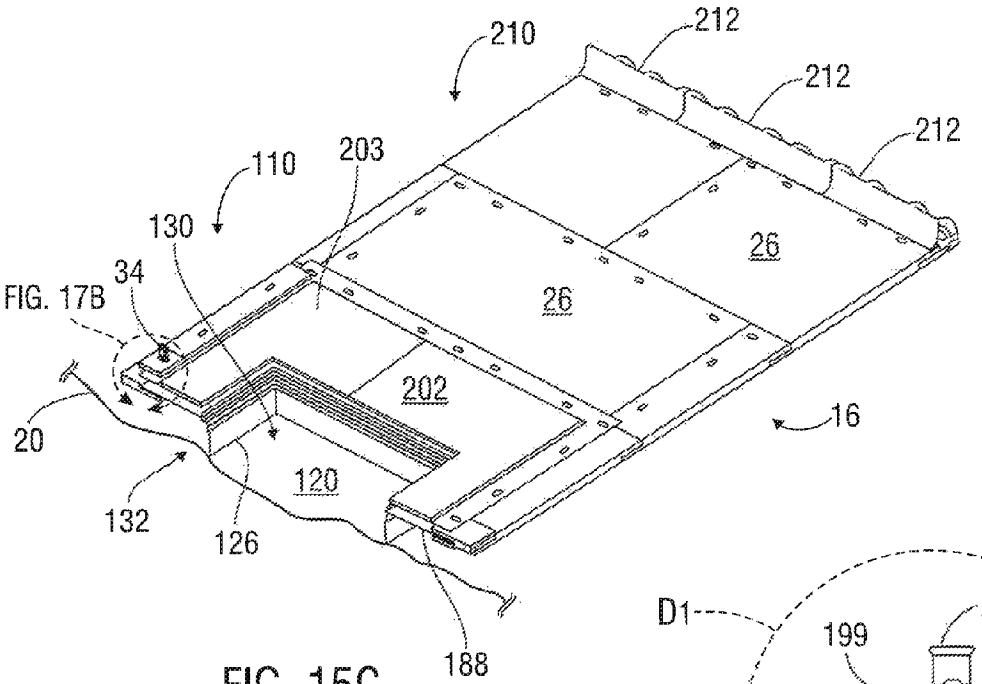
FIG. 15C is a perspective view of the exemplary load-supporting surface shown in FIG. 15B.
Figure 15D:
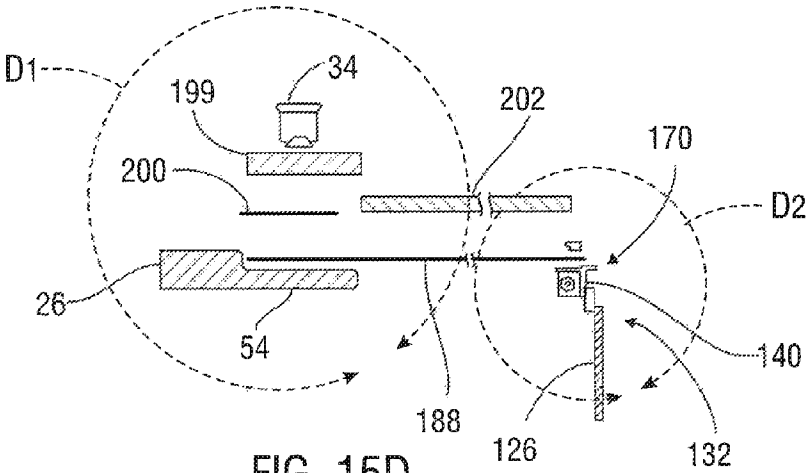
FIG. 15D is an exploded view of portions $D_1$ and $D_2$ of the exemplary borehole edge seal system shown in FIG. 15B.
Figure 16B:
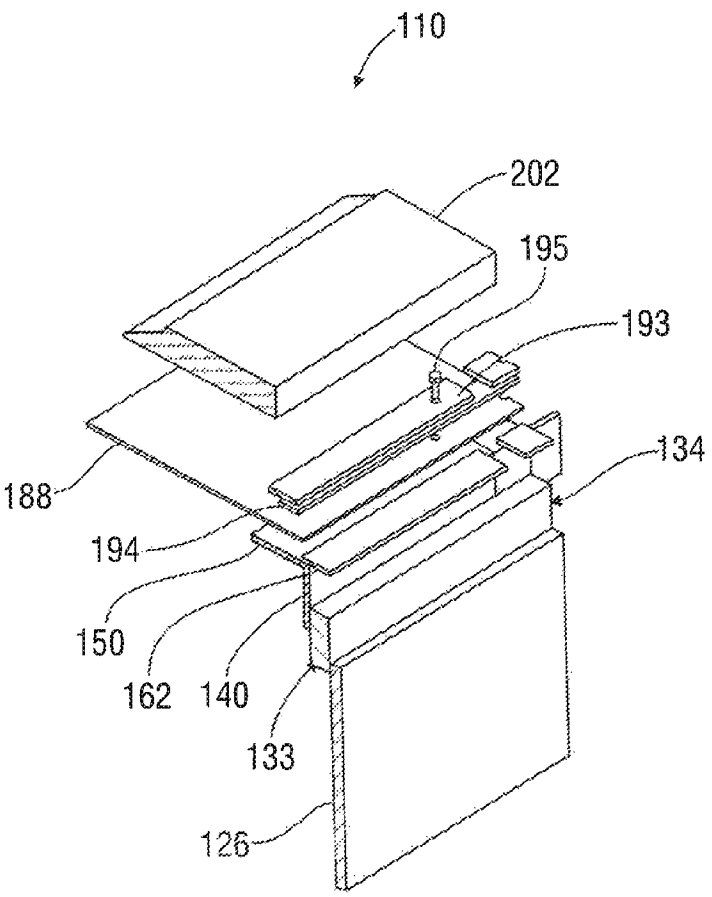
FIG. 16B is a perspective view of components of the exemplary borehole edge seal system shown in FIG. 16A.
Figure 16A:
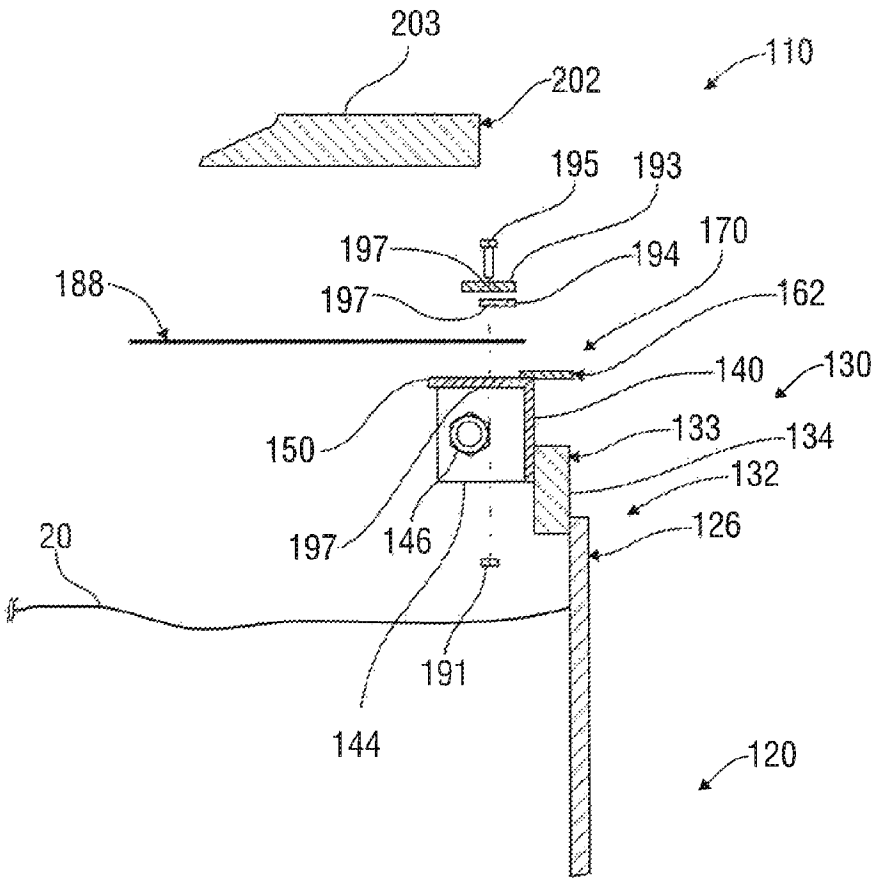
FIG. 16A is exploded, partial cross-sectional, assembly view of components of portion $D_2$ of the exemplary borehole edge seal system shown in FIG. 15D.

Referring to FIGS. 15B and 16A, the illustrated borehole edge seal system 110 is an outside-clamp arrangement, where the clamp 140 engages the outside of the borehole wall 126 (similarly as previously described). Further, the clamp 140 of this embodiment is part of a platform-clamp unit 170. The platform-clamp unit 170 may have any suitable form, configuration and operation. In this example, the platform-clamp unit 170 includes the clamp 140, a platform 150 and an extension 162. As shown, the illustrated extension 162 extends from the clamp 140 in the opposite direction as the platform 150. This may be useful for any suitable purpose. For example, in some applications, the extension 162 may extend at least partially across the top of the borehole wall 126 to assist in positioning or seating the platform-clamp unit 170 on, or relative to, the wall 126. In some embodiments, the clamp 140 and platform 150 may be formed of angle iron, and the extension 162 may be a flat metallic panel welded thereto.

Figure 20:
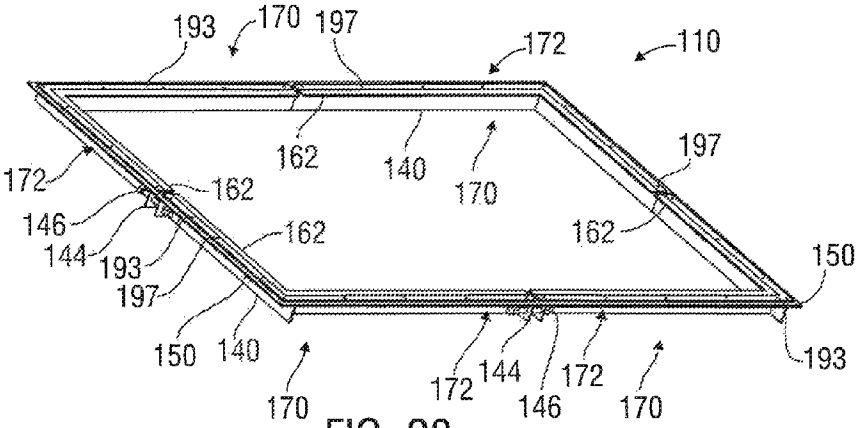
FIG. 20 is a perspective view of an embodiment of a rectangular shaped platform-clamp unit useful in the exemplary borehole edge seal system shown in FIG. 15A.

Similarly as previously described, the platform-clamp unit 170 is placed around the upwardly protruding portion 132 of the borehole wall 126 so that the clamp 140 extends around the outside of the opening 130. As shown in FIG. 20, the exemplary the platform-clamp unit 170 includes four right-angled platform-clamp sections 172 that are useful similarly as the sections 172 described with respect to FIGS. 13-14 above. As shown, the illustrated connection brackets 144 of the clamp 140 are on the outside of the clamp 140 so the clamp 140 can be tightened around the outside of the borehole wall (not shown). However, in other embodiments, the principals and components of the illustrated system 110 are likewise useful in an inside-clamp arrangement (similarly as previously described).

Referring specifically to FIGS. 15A-D, the exemplary borehole edge seal system 110 is shown engaged with a rectangular-shaped borehole wall 126 that extends around the borehole 120. However, the principals and components of the illustrated system 110 may likewise be used with a circular, or other, shaped borehole 120 (similarly as previously described).

The illustrated system 110 in shown used with a load-supporting surface 16 that may be part of a liquid containment system 210, such as the exemplary liquid containment systems described and shown in U.S. patent application Ser. No. 13/790,916, filed Mar. 8, 2013 and entitled "Liquid Containment System for Use with Load-Supporting Surfaces". The illustrated liquid containment system 210 includes, for example, berm members 212 and drive over barriers 214 (see e.g. berm members 80 and drive-over barriers 140 described and shown in U.S. patent application Ser. No. 13/790,916). However, the system 110 is not limited to such application and can be used in connection with any other suitable components.

Referring to FIGS. 16A & 16B, the illustrated system 110 includes at least one exemplary spanner 188 positioned atop and engaged with the platform 150 and extending therefrom away from the borehole wall 126 and borehole 120. The spanner 188 may have any suitable form, configuration and operation. For example, the illustrated spanner 188 is planar and is sealingly engaged between the borehole wall 126 and one or more mats 26 (e.g. FIG. 15D) surrounding the borehole 120. In some embodiments, multiple spanners 188 may be used around the borehole 120.

In this particular embodiment, the spanner 188 is constructed flexible (non-rigid) poly-liner material that is mechanically coupled at one or more of its ends to the platform 150. A presently commercially available example of flexible poly-liner material that may be used for the spanner 188 for some applications is relatively thin (e.g. 60 mil) SOLMAX 460ST-2000 HDPE Geomembranel. For example, an elongated spanner support 193 may be placed over part of the spanner 188 and used to selectively, releasably, mechanically couple the spanner 188 to the platform 150 in forming a liquid tight seal between the spanner 188 and platform 150. As used herein, the term "elongated" and variations thereof means having a length that is greater than its width and thickness. In this embodiment, the spanner support 193 is coupled to the spanner 188 and platform 150 with one or more bolts 195 and nuts 191 (or other suitable connectors) extending through respective aligned component holes 197. This embodiment thus does not require on-site thermoplastic welding of components, such as may be necessary with the use of previously described thermoplastic sealant material 160 (e.g. FIGS. 6 & 11).

The spanner support 193 may have any suitable form, configuration and operation. In this embodiment, the exemplary spanner support 193 is a rigid, metallic panel. In other embodiments, the spanner support 193 may instead be constructed of plastic or other material, be flexible, or a combination thereof.

Referring back to FIGS. 16A and 16B, if desired, one or more sealants or sealing members may be used to assist in providing a liquid-tight seal along the intersection of the borehole edge seal system 110 and the borehole wall 126.

For example, one or more elongated spanner support seals 194 (e.g. neoprene rubber) may be sandwiched between the spanner support 193 and the spanner 188 to assist in providing a liquid-tight seal at that intersection. For another example, one or more elongated seal members 133, such as a closed-cell neoprene foam rubber or elastomeric seal ring 134, may be sandwiched between the clamp 140 and borehole wall 126 to assist in providing a liquid-tight seal at that intersection. In this embodiment, the seal member 133 is compressed, or squeezed, between the clamp 140 and borehole wall 126.

Figure 17B:
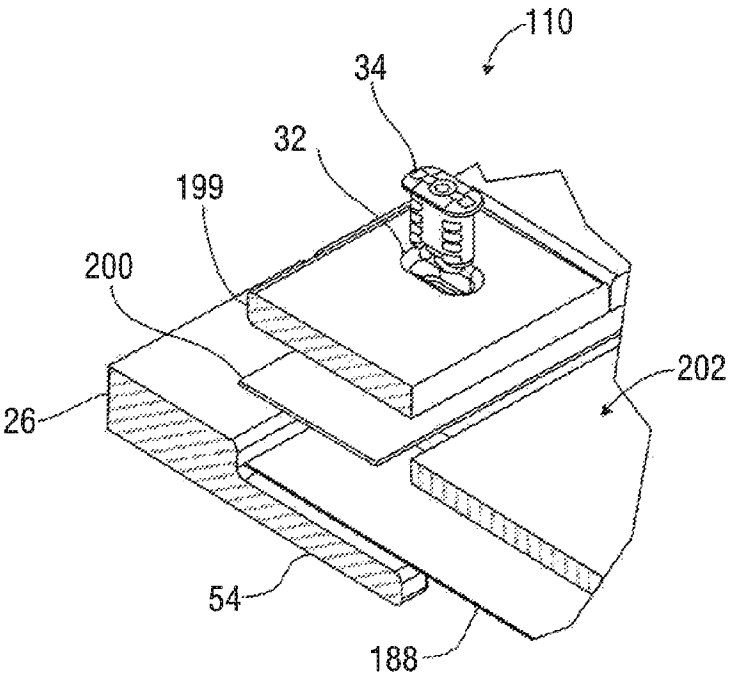
FIG. 17B is a perspective view of the exemplary borehole edge seal system shown in FIG. 17A.
Figure 17A:
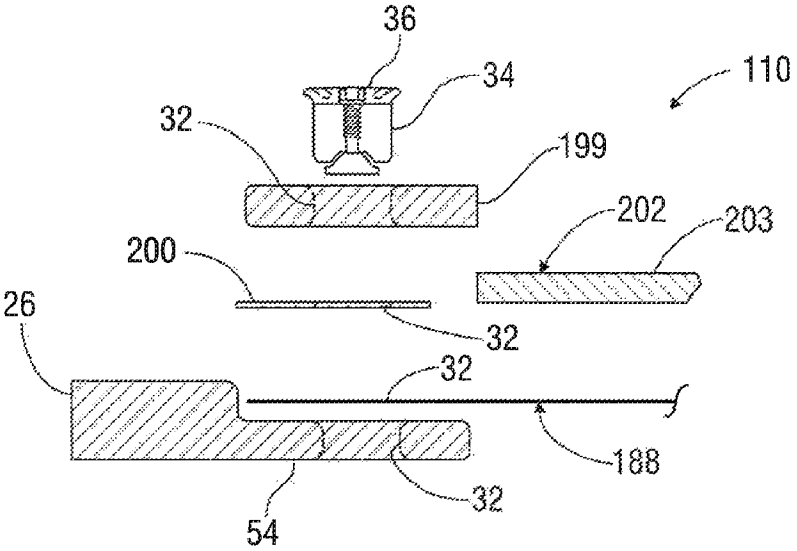
FIG. 17A is an exploded, partial cross-sectional, assembly view of components of portion $D_1$ of the exemplary borehole edge seal system shown in FIG. 15D.
Figure 18:
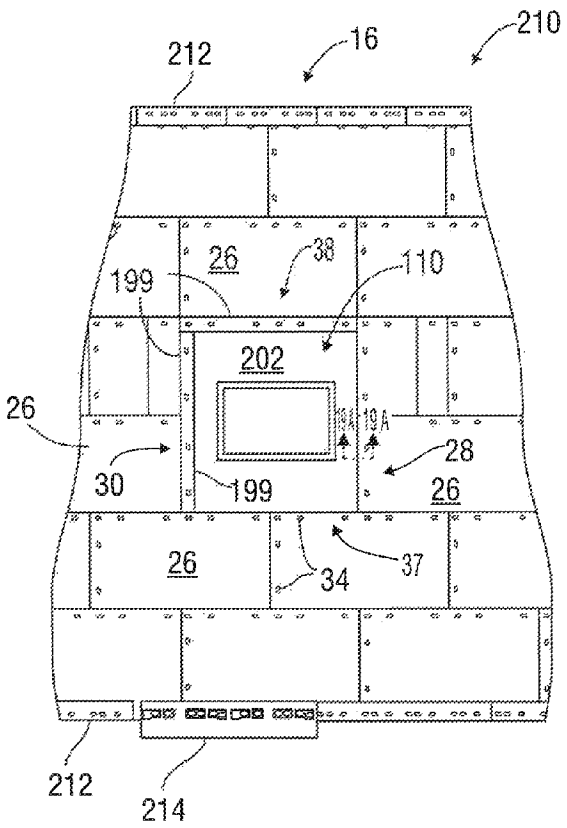
FIG. 18 is a partial top view of the exemplary load-supporting surface and borehole edge seal system of FIG. 15A.

Now referring to FIGS. 17A & 17B, the exemplary spanner 188 extends at one or more ends to, and engages, one or more of the mats 26 surrounding the borehole 120 (e.g. FIG. 15A). The spanner(s) 188 may engage the adjacent mat(s) 26 in any suitable manner. For example, the spanner 188 may be mechanically coupled to the adjacent mats 26.

Figure 19B:
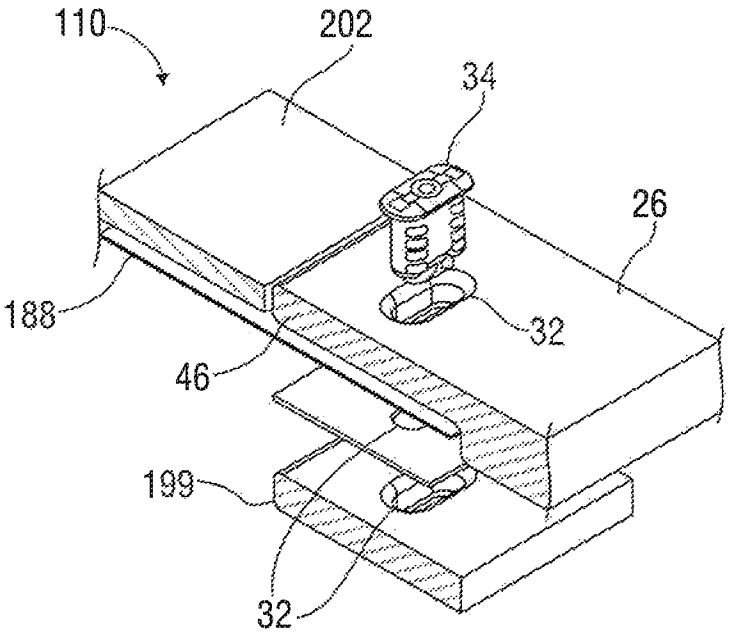
FIG. 19B is a perspective view of the exemplary load-supporting surface and borehole edge seal system of FIG. 19A.
Figure 19A:
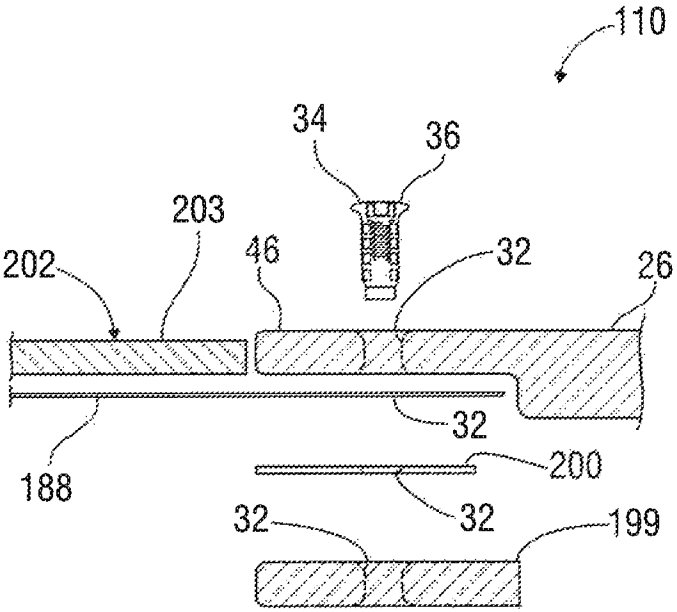
FIG. 19A is an exploded, partial cross-sectional, assembly view of the exemplary load-supporting surface and borehole edge seal system of FIG. 18 taken along lines 19A-19A.

In the present embodiment, the exemplary borehole edge seal system 110 (FIG. 18) is shown positioned between the upper lips 28, 37 of adjacent mats 26 on its right and bottom sides, and the lower lips 30, 38 of adjacent mats 26 on its left and top sides in the load-supporting surface 16. In FIGS. 17A & 17B, the spanner 188 is shown engaging the lower lip 54 of an adjacent mat 26. For example, an elongated lip support 199 may be positioned atop part of the spanner 188 and used to selectively, releasably, mechanically couple the spanner 188 to the lower lip 54 of the mat 26 in forming a liquid tight seal between the spanner 188 and the lower lip 54. The exemplary lip support 199 thus fills in at least part of the space created by the lower lip 54. In FIGS. 19A & 19B, the exemplary lip support 199 is shown coupling the spanner 188 to the upper lip 46 of an adjacent mat 26. In this example, the lip support 199 is positioned below the spanner 188 and upper lip 46. The exemplary spanner 188 thus fills in at least part of the space created by the upper lip 46.

The lip support 199 may have any suitable form, configuration and operation. For example, the lip support 199 may be constructed of the same thermoplastic material as the mat 26. In some embodiments, multiple different-sized lip supports 199 may be used (e.g. 7' long×12" wide and 13' long×12" wide) at different locations. If desired, one or more sealants or sealing members may be used to assist in providing a liquid-tight seal along the intersection of the spanner 188 and mat 26. For example, one or more elongated lip support seals 200 (e.g. closed-cell foam neoprene) may be sandwiched between the lip support 199 and the spanner 188.

Any suitable mechanism may be used to mechanically couple the lip support 199 to the adjacent components. In this embodiment, at least one locking pin 34 extends through aligned locking pin holes 32 formed in the lip support 199, the spanner 188, lip support seal 200 and mat(s) 26.

In some embodiments, one or more covers 202 (e.g. FIGS. 15A-C) may be placed atop the spanner 188 between the mats 26 that surround the borehole edge seal system 110 and borehole 120. This may be useful in some embodiments, for example, to protect the spanner 188 from damage. The cover 202 may have any suitable form, configuration and operation. In this embodiment, the cover 202 includes one or more protective rubber mats 203 that lie atop, extend across and cover the entire spanner 188 (or multiple spanners 188). For example, the rubber mats 203 may be formed in 4'×6' sheets and interconnect with one another in any suitable manner.

In accordance with all of the above embodiments of the present disclosure, if the borehole 120 overflows with liquid(s) and/or solids, the borehole edge seal system 110 and related components will, in some applications prevent, or otherwise assist in preventing such liquid(s) and/or solids from at least substantially contacting or contaminating the earth's surface (or other surface or area) adjacent to the borehole 120. Further, in at least some embodiments, this may be accomplished without the need for any liners below or adjacent to the system 110 and/or load-supporting surface 16. It should be noted that, in all of the above embodiments, one or more sealants may be used at any intersection of components and/or one or more seals placed between components, such as to assist in providing a liquid-tight seal around the opening 130 to the borehole 120. Any suitable sealant, such as silicone glue, may be used.

If desired, the borehole edge seal system 110 may be part of a spill management system to prevent liquid leakage from one or more permanent, semi-permanent or temporary load-supporting surfaces 16 and facilitate clean-up or disposal of such liquid. For example, the system 110 may be used in conjunction with technology shown and disclosed in any combination of the aforementioned patents and patent applications, such as to provide a self-contained liquid barrier system around and across the load-supporting surface 16 without the need for any liners below or adjacent to the load-supporting surface 16.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of any appended claims, and may be made and used by one of ordinary skill in the art without departing from the spirit or teachings of the invention and scope of this disclosure and any appended claims. Thus, all matter herein set forth or shown in the accompanying drawings should be interpreted as illustrative, and the scope of the disclosure and any appended claims should not be limited to the embodiments described and shown herein.

The invention claimed is:

1. Apparatus useful for providing a liquid-tight seal around a cellar formed around a hydrocarbon exploration or production well, the cellar having an opening and a wall formed of wood, cement, metal or other material extending around its opening, the apparatus comprising:

a reusable load-supporting surface including at least two reusable, load-bearing mats configured to support the weight of personnel, vehicles and equipment thereupon, said mats being positioned at least partially adjacent to one another relative to the cellar opening and spaced away from and at least partially surrounding the cellar opening;

at least one planar spanner configured to extend between the cellar wall and said mats;

at least one elongated spanner support that is separate and distinct from said at least one elongated spanner, and is configured to be positioned atop part of at least one said spanner proximate to the cellar wall and mechanically couple said at least one spanner to the cellar wall to assist in forming a liquid tight seal therebetween; and at least one elongated lip support configured to be positioned atop or below part of at least one said spanner proximate to at least one said mat and spaced away from said at least one elongated spanner support and the cellar wall, said at least one elongated lip support being separate and distinct from said at least one elongated spanner and said at least one elongated spanner support, arranged and adapted to mechanically couple said at least one spanner to at least one said mat and assist in forming a liquid tight seal therebetween, wherein liquid exiting the cellar through the cellar opening is prevented from contacting the earth's surface around the cellar opening.

2. The apparatus of claim 1 wherein each said spanner is constructed of poly-liner material, each said lip support is constructed of thermoplastic material and each said spanner support is constructed of metal.

3. The apparatus of claim 1 further including at least one platform-clamp unit configured to sealingly engage the cellar wall, wherein said at least one spanner support is configured to releasably mechanically couple said at least one spanner to said platform-clamp unit to form a liquid tight seal between said at least one spanner and the cellar wall.

4. The apparatus of claim 3 wherein each said platform-clamp unit is constructed at least partially of angle iron.

5. The apparatus of claim 3 wherein each said platform-clamp unit includes a clamp configured to extend around the cellar wall, a platform extending from said clamp away from the cellar and an extension extending from said clamp toward the cellar.

6. The apparatus of claim 5 wherein at least one said spanner is configured to be coupled to said platform and said extension is configured to extend at least partially over the top of the cellar wall to assist in positioning said platform-clamp unit relative to the cellar wall.

7. The apparatus of claim 3 further including at least one elongated seal member sandwiched between each said platform-clamp unit and the cellar wall.

8. The apparatus of claim 1 further including at least one elongated spanner support seal configured to be sandwiched between each said spanner support and at least one said spanner.

9. The apparatus of claim 8 further including at least one elongated lip support seal configured to be sandwiched between each said lip support and at least one said spanner.

10. The apparatus of claim 1 further including at least one removable cover configured to rest atop and protect said at least one spanner.

11. The apparatus of claim 10 wherein said removable cover includes at least one rubber mat.

12. The apparatus of claim 1 further including a plurality of releasable locking pins, at least one said locking pin configured to releasably mechanically couple each said lip support to at least one said spanner and at least one said mat.

13. Method of providing a liquid-tight seal around a cellar formed around a hydrocarbon exploration or production well, the cellar having an opening and a wall formed of wood, cement, metal or other material extending around its opening, the method comprising:

positioning at least two load-bearing mats of a reusable load-supporting surface at least partially adjacent to one another relative to the cellar opening and around, and spaced-apart from, the cellar opening, the mats being configured to support the weight of personnel, vehicles and equipment thereupon;

extending at least one planar spanner between the cellar wall and at least one mat;

positioning at least one elongated spanner support atop part of at least one spanner proximate to the cellar wall, the at least one elongated spanner support being separate and distinct from the at least one spanner;

releasably mechanically coupling each spanner support to its associated spanner(s) and the cellar wall to assist in forming a liquid tight seal between its associated spanner(s) and the cellar wall;

positioning at least one elongated lip support atop or below part of at least one spanner proximate to at least one mat and spaced away from the at least one elongated spanner support and cellar wall, the at least one elongated lip support being separate and distinct from the at least one spanner and the at least one elongated spanner support; and releasably mechanically coupling each elongated lip support to the at least one spanner and at least one mat associated therewith to assist in forming a liquid tight seal between the at least one associated spanner and mat, wherein liquid exiting the cellar through the cellar opening is prevented from contacting the earth's surface around the cellar opening.

14. The method of claim 13 further including sealingly engaging at least one platform-clamp unit to the cellar wall, wherein each spanner support releasably mechanically couples at least one spanner to at least one platform-clamp unit to form a liquid tight seal between the spanner and cellar wall.

15. The method of claim 14 wherein each platform-clamp unit includes a clamp, a platform extending from the clamp away from the cellar and an extension extending from the clamp toward the cellar, further including the clamp extending around the cellar wall, and the extension extending at least partially across the top of the cellar wall to assist in positioning the platform-clamp unit relative to the cellar wall, wherein the spanner is mechanically coupled to the platform.

16. The method of claim 14 further including sandwiching at least one elongated seal member between each platform-clamp unit and the cellar wall.

17. The method of claim 13 further including sandwiching at least one elongated spanner support seal between each spanner support and at least one spanner.

18. The method of claim 17 further including sandwiching at least one elongated lip support seal between each lip support and at least one spanner.

19. The method of claim 13 further including positioning at least one removable cover atop and each spanner.

20. The method of claim 13 wherein each mat includes an upper lip extending along at least one edge thereof and a lower lip extending along at least one edge thereof, wherein when the lower lip of a mat is closest to the cellar opening, the elongated lip support is positioned atop the associated spanner and lower lip of the mat.

21. The method of claim 20 wherein when the upper lip of a mat is closest to the cellar opening, the elongated lip support is positioned below the associated spanner and upper lip of the mat.

* * * * *